US006006493A

United States Patent [19]

Focke et al.

[11] Patent Number: 6,006,493

[45] Date of Patent: Dec. 28, 1999

[54] APPARATUS FOR FILLING CARTONS

[75] Inventors: Heinz Focke, Verden; Hugo Mutschall, Kirchlinteln, both of Germany

[73] Assignee: Focke & Co., Verden, Germany

[21] Appl. No.: 08/997,693

[22] Filed: Dec. 23, 1997

[30] Foreign Application Priority Data

Jan. 6, 1997 [DE] Germany ..... 197 00 150

[51] Int. Cl.[6] ..... B65B 35/30

[52] U.S. Cl. ..... 53/247; 53/244; 53/537; 53/543

[58] Field of Search ..... 53/244, 246, 247, 53/537, 538, 539, 543

[56] References Cited

U.S. PATENT DOCUMENTS

| | | | |
|---|---|---|---|
| 3,069,035 | 12/1962 | Schwarz et al. . | |
| 3,505,787 | 4/1970 | Tiews | 53/247 X |
| 3,553,932 | 1/1971 | Rowekamp | 53/247 X |
| 3,555,770 | 1/1971 | Rowekamp | 53/247 X |
| 3,783,587 | 1/1974 | Kurtenbach | 53/247 |
| 4,051,652 | 10/1977 | Hirano et al. | 53/247 X |
| 4,055,943 | 11/1977 | Reichert | 53/247 |
| 4,191,003 | 3/1980 | Talarico | 53/247 |
| 4,402,173 | 9/1983 | Thierion . | |
| 4,793,762 | 12/1988 | Munch et al. | 53/250 X |
| 5,105,606 | 4/1992 | Creed et al. . | |
| 5,257,888 | 11/1993 | Kronseder | 53/247 X |
| 5,375,395 | 12/1994 | Gmeiner | 53/247 X |
| 5,456,563 | 10/1995 | Halbo | 53/250 X |
| 5,487,257 | 1/1996 | Domeier et al. | 53/247 X |

FOREIGN PATENT DOCUMENTS

| | | |
|---|---|---|
| 028 762 | 5/1981 | European Pat. Off. . |
| 116376 | 8/1984 | European Pat. Off. . |
| 487017 | 5/1992 | European Pat. Off. . |
| 638478 | 2/1995 | European Pat. Off. . |
| 2037798 | 7/1972 | Germany . |
| 2708160 | 9/1978 | Germany . |
| 29 35 045 | 3/1981 | Germany . |
| 3316479 | 11/1984 | Germany . |
| 3422026 | 12/1985 | Germany . |
| 3420143 | 3/1986 | Germany . |
| 3617508 | 11/1987 | Germany . |
| 267008 | 4/1989 | Germany . |
| 3842556 | 11/1989 | Germany . |
| 4131067 | 4/1992 | Germany . |
| 4125573 | 5/1992 | Germany . |
| 9311046 | 6/1994 | Germany . |
| 4124161 | 7/1994 | Germany . |
| 48-68395 | 9/1973 | Japan . |
| 60-23105 | 2/1985 | Japan . |
| 5-112304 | 5/1993 | Japan . |
| 1375703 | 11/1974 | United Kingdom . |
| 2066197 | 7/1981 | United Kingdom . |

OTHER PUBLICATIONS

Hain, Kurt: Angewandte Getriebelehre,2.uberarb. Aufl., VDI–Verlag, Dusseldorf, 1961, S.252 [No Translation].

*Primary Examiner*—Daniel B. Moon
*Attorney, Agent, or Firm*—Sughrue, Mion, Zinn Macpeak & Seas, PLLC

[57] ABSTRACT

For the transportation of articles or of groups of articles between a fixed, predetermined receiving position (20) and a likewise predetermined, fixed set-down position (19), in particular within a folding carton (11) which is open at the top, use is made of a lifting conveyor (21) which transports a lifting head (18) back and forth exclusively along a predetermined inverted U-shaped movement path. The movement path is provided by: two upright vertical movement legs, namely in the set-down position (19), on the one hand, and on the other hand, in the receiving position (20); and a top, horizontal conveying section which interconnects the top of the two vertical movement legs and which is of unchangeable horizontal length.

9 Claims, 6 Drawing Sheets

APPARATUS FOR FILLING CARTONS

BACKGROUND OF THE INVENTION

The invention relates to an apparatus for handling articles by receiving, transporting and setting down the same, in particular for filling containers—cartons—with articles or groups of articles, it being possible for a lifting head for gripping and retaining one or more articles to be moved by a conveyor.

Various designs of apparatuses for the automatic filling of containers, in particular (folding) cartons, are known. Such apparatuses are primarily used for receiving relatively small packs, for example, those containing foodstuffs or luxury foods, from a pallet or an incoming feed conveyor and transferring these packs in layers to the carton. For this purpose, widespread use has been made to date of robots with articulated arms of complex design for carrying out the movement sequence for receiving, transporting and setting down the articles.

SUMMARY OF THE INVENTION

The objective of the invention is to propose an apparatus for handling articles which has a particularly straightforward, and thus cost-effective, construction and, without the use of complex control elements, ensures precise movements during handling of the articles.

In order to achieve this objective, the apparatus according to the invention is characterized in that the lifting head can be moved by the conveyor (exclusively) between a predetermined position for receiving the articles and a likewise predetermined set-down position, in particular within a container.

A special feature of the apparatus according to the invention consists in the fact that the lifting head which transports the articles can always be moved between two "fixed points", namely a position for receiving the articles and a position for setting these articles down, said lifting head being moved, specifically, along a simple U-shaped movement path which runs in a vertical plane. In this case, vertical movement sections of the lifting head can be changed according to the invention, in particular the downward directed conveying section for setting the articles down, in order to take account of the increasing filling level of the container. The horizontal movement section is always of the same length, i.e., unalterable.

As a result, the handling apparatus can be designed very simply. The lifting head is arranged on a conveyor which can move back and forth, namely an (endless) toothed belt in particular. This moves via at least two top deflection rollers, which determine the horizontal length of the movement path of the lifting head. Special mounting of the lifting head on a transversely displaceable carriage ensures that the lifting head executes an exclusively translatory movement over the entire conveying section.

Another special feature of the invention consists in the fact that the fixed, predetermined position for setting the articles down is taken into account for the positioning of containers of different sizes. The containers are always placed at a predetermined position relative to a fixed point or to an aligned position, to be precise, irrespective of the size of the container. This ensures that it is possible to load containers of very different sizes. For large differences in dimension, the invention provides for a retaining element of the lifting head, in particular a suction plate, arranged exchangeably on the lifting head, with the result that, for larger containers and correspondingly larger layers of articles, a larger suction plate is used. The characteristic movement of the lifting head remains unchanged.

Further features of the invention relate to the configuration of the lifting conveyor and the positioning of the same relative to the receiving and set-down position.

An exemplary embodiment of the apparatus, or system, according to the invention is explained in more detail as follows, with reference being made to the drawings, in which:

DESCRIPTION OF PREFERRED EMBODIMENTS

Figure 1:
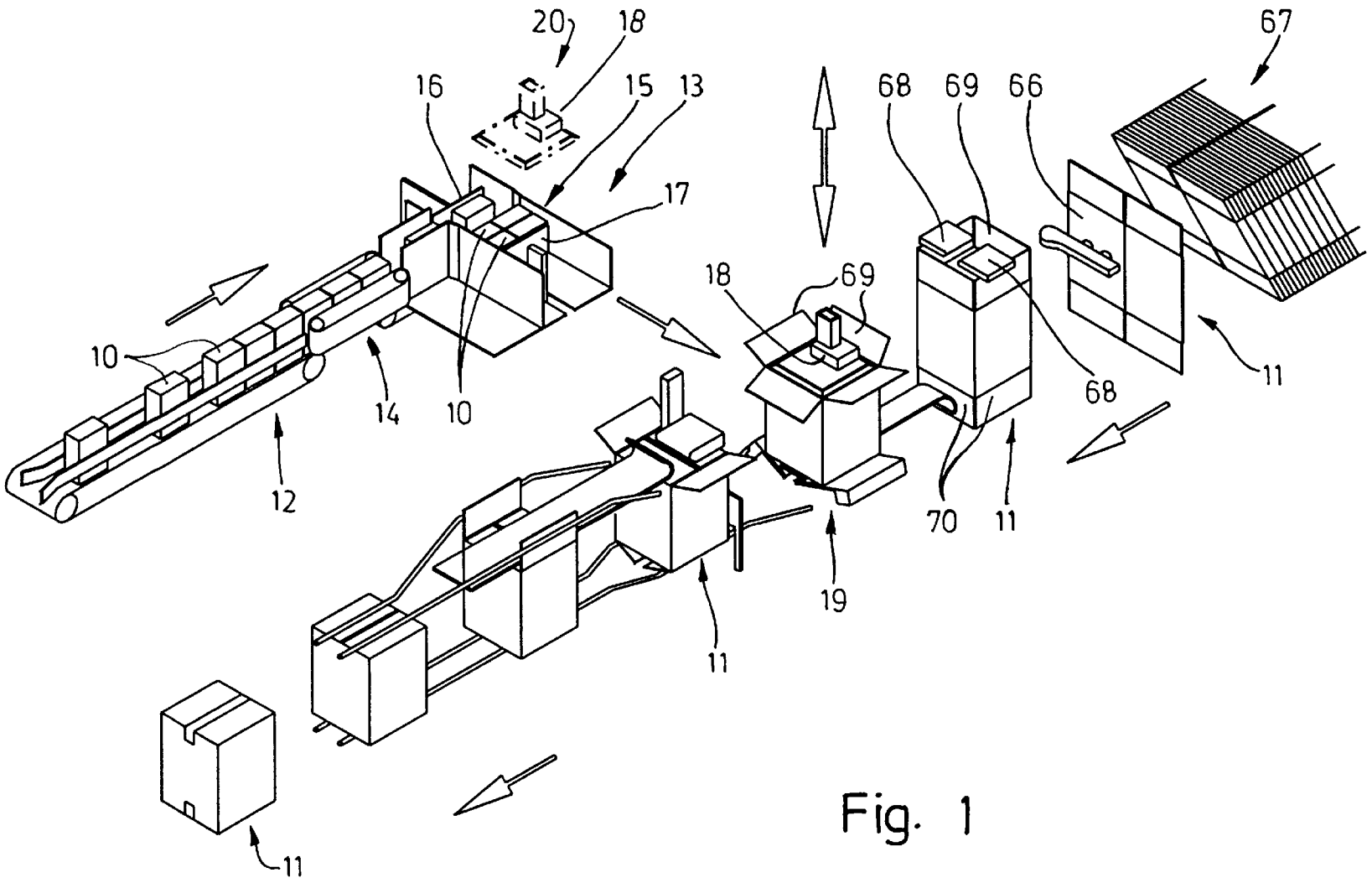
FIG. 1 shows a general perspective view of an apparatus for filling folding cartons, FIG. 2 likewise in perspective view, shows operating sequences for different container sizes, namely folding cartons.

In the preferred example of application, the drawings show the operation of articles, namely, (small) packs 10 being introduced into folding cartons 11. The packs 10 may be those for foodstuffs or luxury goods. The system shown is particularly suitable for introducing soft packs for cellulose products, for example, disposable diapers, paper handkerchiefs, etc., into the folding cartons 11.

The individual packs 10 are fed on a conveying path by means of a feed conveyor to a gripping station 13. The packs 10, which are first conveyed at a distance to one another, accumulate in the region of an accumulating conveyor 14, with a closely-packed row being formed in the process. Packs 10 are successively separated from the latter in pairs and brought together in the region of the gripping station 13, a pack group 15 being formed in the process. In this case, the latter comprises six packs 10 arranged in two rows. The pack group 15 is brought into a precise position, namely a receiving position 20, between movable supporting walls 16 and 17. This receiving position 20 is exactly predetermined and defined by the movable supporting walls 16, 17.

In the region of the receiving position, the pack group 15 is gripped as a unit by a lifting head 18, raised, moved horizontally in the raised position and, upon being located above a container, namely folding carton 11, moved downwards into a set-down position 19, the pack group 15 being introduced into the folding carton 11, which is open at the top. Once the pack group 15 has been set down in the folding carton 11, the lifting head 18 is first moved vertically, then horizontally, until it reaches the receiving position 20 above the (next) pack group 15. Accordingly, the lifting head 18 executes a constant repeating movement along a U-shaped movement path in a vertical plane. If a container or folding carton 11 is suitable for receiving a plurality of pack groups 15 or stacked layers, the vertical leg of the U-shaped movement, i.e., the section for downward movement in the region of the folding carton 11, may be correspondingly shorter. In this case, the lifting head 18 is controlled by simple sensor elements.

Lifting head 18 is part of a specially-designed lifting conveyor 21. The latter is fixed between the receiving position 20 and the set-down position 19. Lifting head 18 is moved back and forth between these end positions by a conveying element of the lifting conveyor 21. In the present case, the conveying element is an endless conveyor, more precisely, a toothed belt 22. The lifting head is fastened onto the latter. Movement of the toothed belt 22 in one direction or the other causes the lifting head 18 to move correspondingly.

The (endless) toothed belt 22 runs via top deflection rollers 23, 24. These are arranged in a common horizontal plane, with the result that the toothed belt 22 forms a horizontal section 25 between the two deflection rollers 23 and 24. Correspondingly, bottom deflection rollers 26, 27 are mounted in a vertical plane beneath the deflection rollers 23 and 24, respectively. This produces vertical sections 28 and 29 of the toothed belt 22. The bottom deflection rollers 26, 27 are arranged so as to be offset vertically with respect to one another. The deflection roller 27 is located at a lower level than deflection roller 26, with the result that section 29 is longer than section 28. Deflection roller 26 serves here as a drive roller, which is assigned a motor 30 with a clutch 31 and gear unit 32. An adjustable tensioning roller 33 for the toothed belt 22 is arranged in an offset position, half-way up between the deflection rollers 26 and 27.

Lifting head 18 is connected to the toothed belt 22 via a mount, to be precise via an upright carrying arm 34, such that during movements between receiving position 20 and set-down position 19 lifting head 18 executes a translatory movement. Carrying arm 34 always remains in the upright position. For this purpose, lifting head 18, or its carrying arm 34, is indirectly connected to the toothed belt 22, namely via an intermediate mechanism. The latter comprises a lever parallelogram 35 with two parallel levers 36 and 37 and a horizontally movable mount therefor. Each of the levers 36, 37 have one end connected via articulations 38, 39 to the lifting head 18, or to the top part of the carrying arm 34, and are spaced from one another in a common vertical plane.

The other respective ends of the levers 36, 37 are connected, via corresponding articulation 40, 41, to a horizontally movable mount, namely to a carriage 42. The latter is configured in the form of a plate. Arranged in the region of a widened section are two articulations 40, 41, which are likewise spaced apart from one another in a vertical plane. These articulations 40, 41 are fixed points for the lever parallelograms 35 and can only be moved in a horizontal plane.

The carriage 42, for its part, is mounted on a guide which permits horizontal movement when the toothed belt 22 is driven in one direction or the other. In the case at hand, the guide comprises a main plate or base plate 43. The latter forms the stationary carrying element for the lifting conveyor 21. The base plate 43 may be connected to a carrying device (not shown) resting, for example, on the floor.

Carriage 42 with a U-shaped cross-section is fastened displaceably in the bottom border region of the base plate 43 by means of a bottom, transversely directed carrying leg 44. Extending on that side of the base plate 43, which is located opposite of the toothed belt 22, is a carrier, more precisely a carrying tube 45. The carriage 45 is mounted displaceably on the latter by means of a sliding element 46 on the carrying leg 44. The carriage 42 can thus be moved back and forth in a horizontal plane on the base plate 43 or in front of the same.

At the top end, the carriage 42 is supported on a base plate 43, more precisely supporting rollers 47, 48 which are arranged on both sides of the base plate 43 and rest against the latter. These supporting rollers are mounted on a top, transversely directed leg 49 of the carriage 42 so as to rotate around vertical axes.

Figure 4:
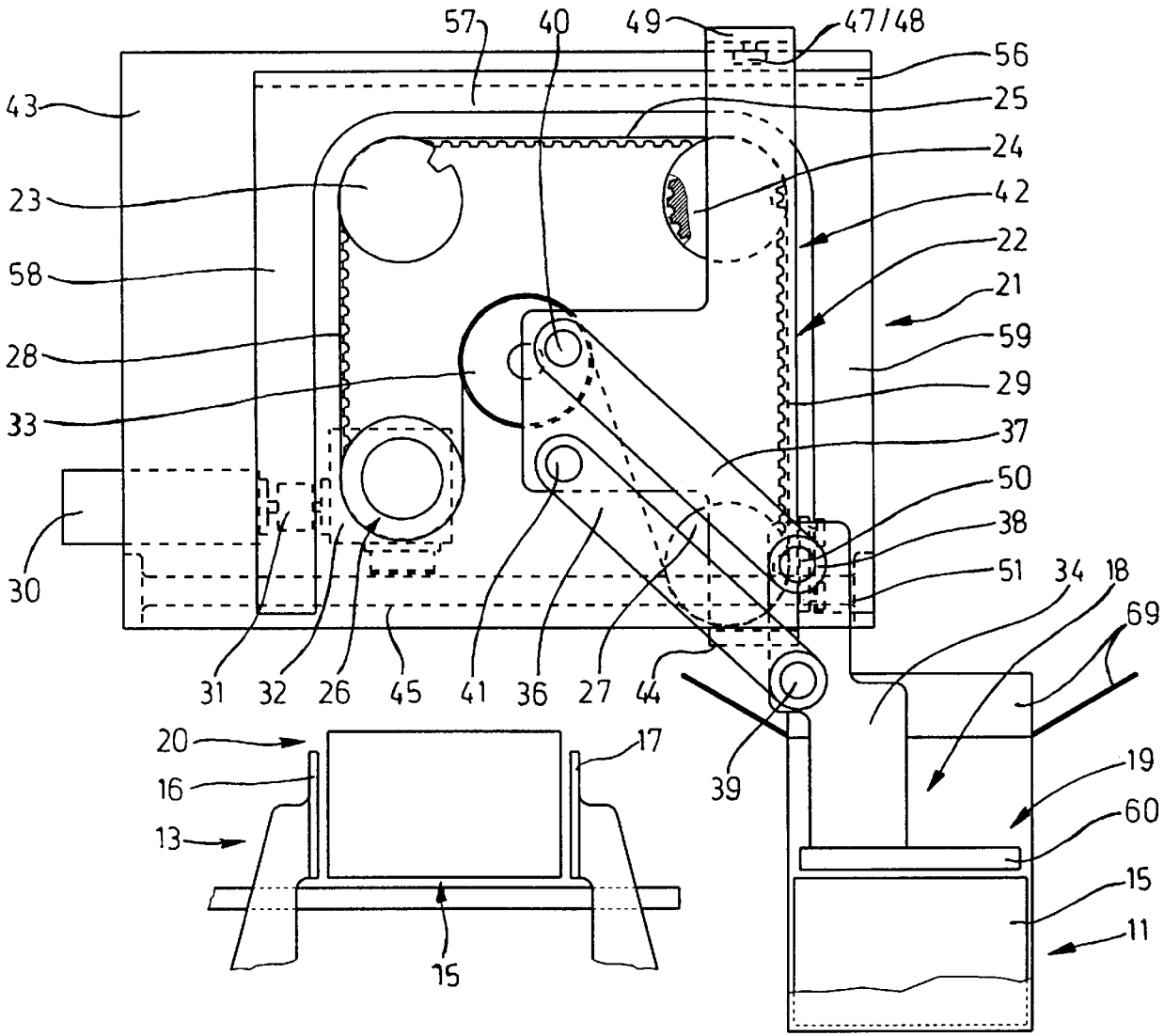
FIG. 4 shows a side view, partly in section, of a lifting conveyor for the articles.
Figure 5:
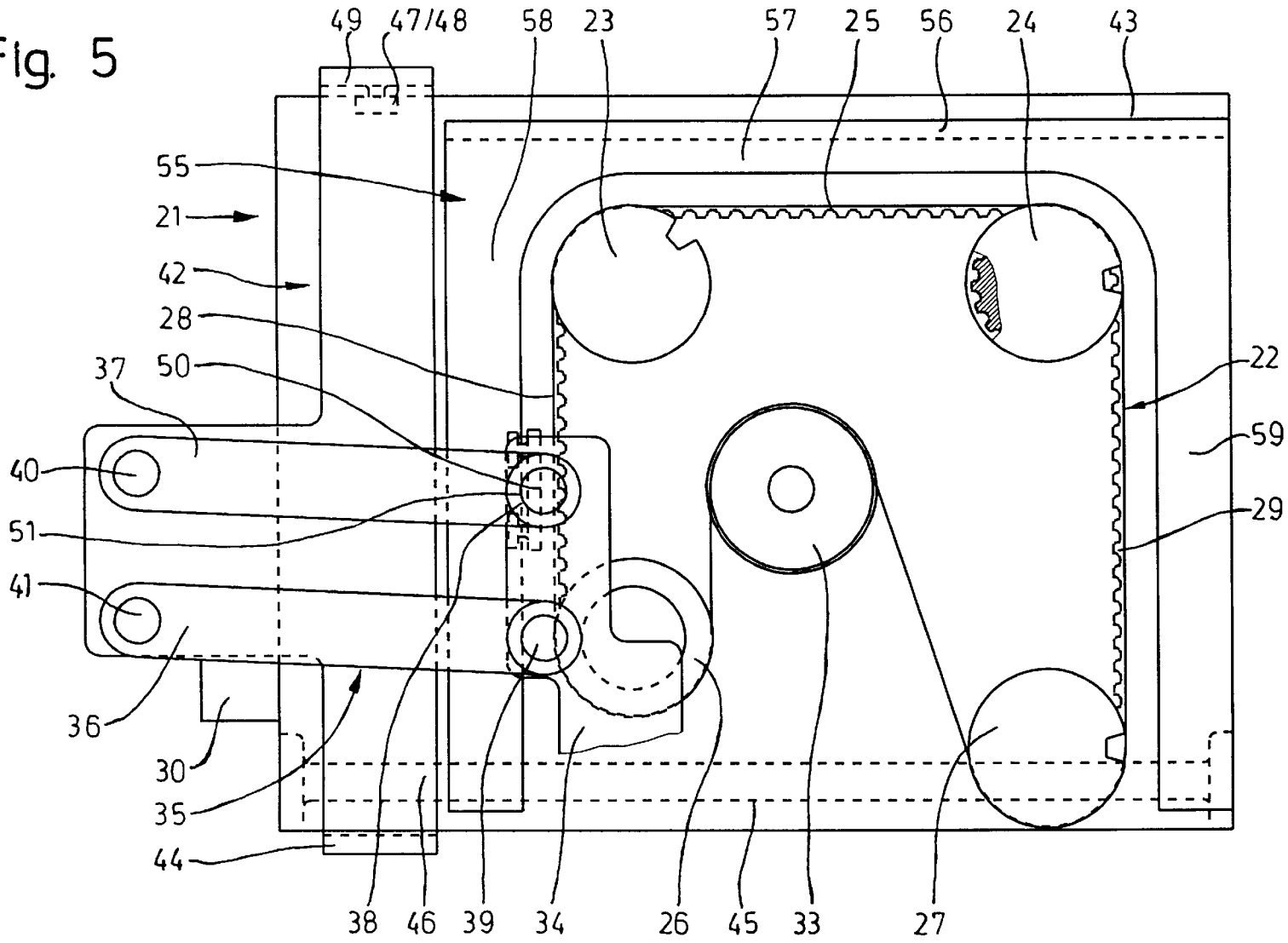
FIG. 5 shows the lifting conveyor according to FIG. 4 in a different relative position.
Figure 6:
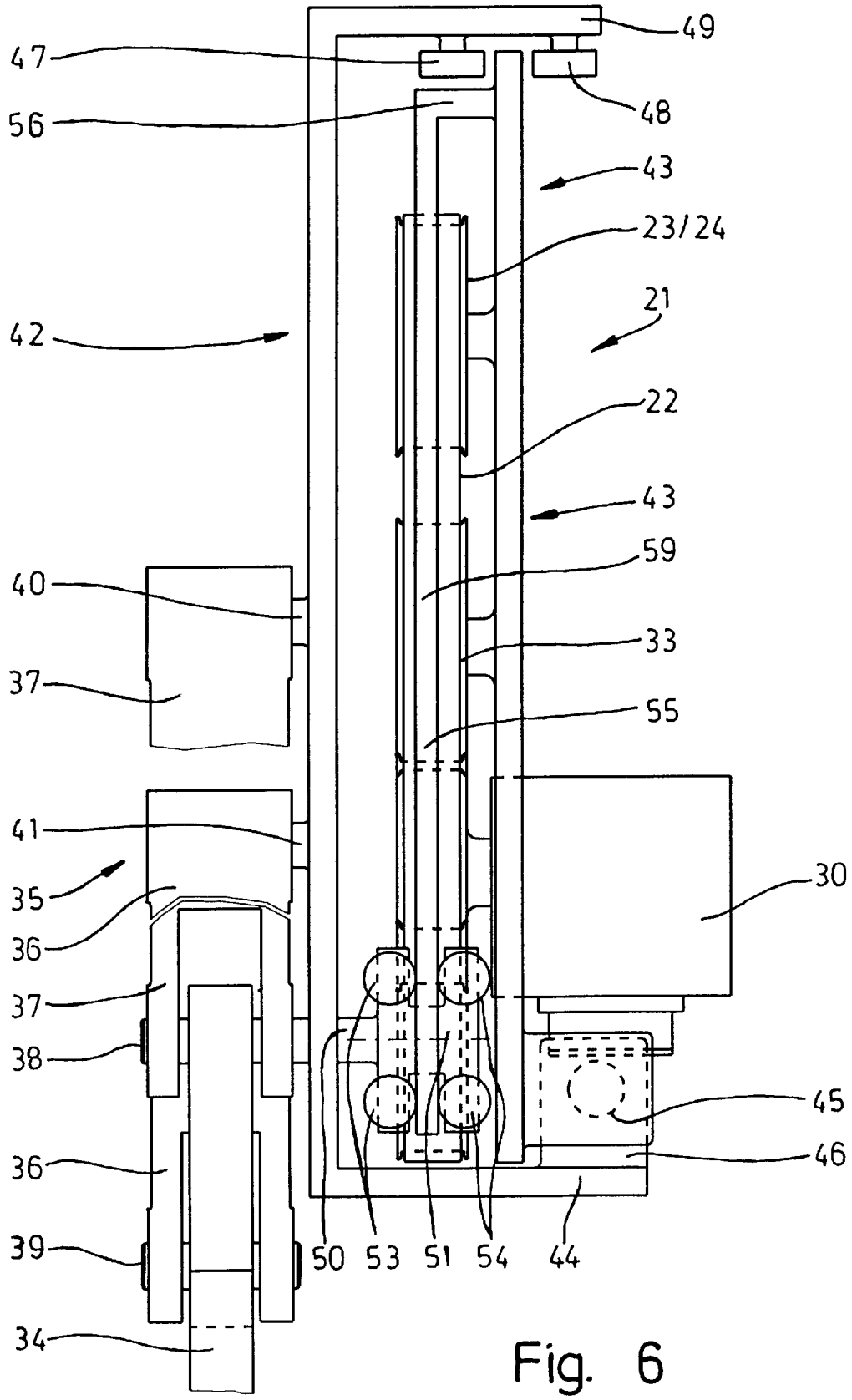
FIG. 6 shows a transverse view of the lifting conveyor.
Figure 7:
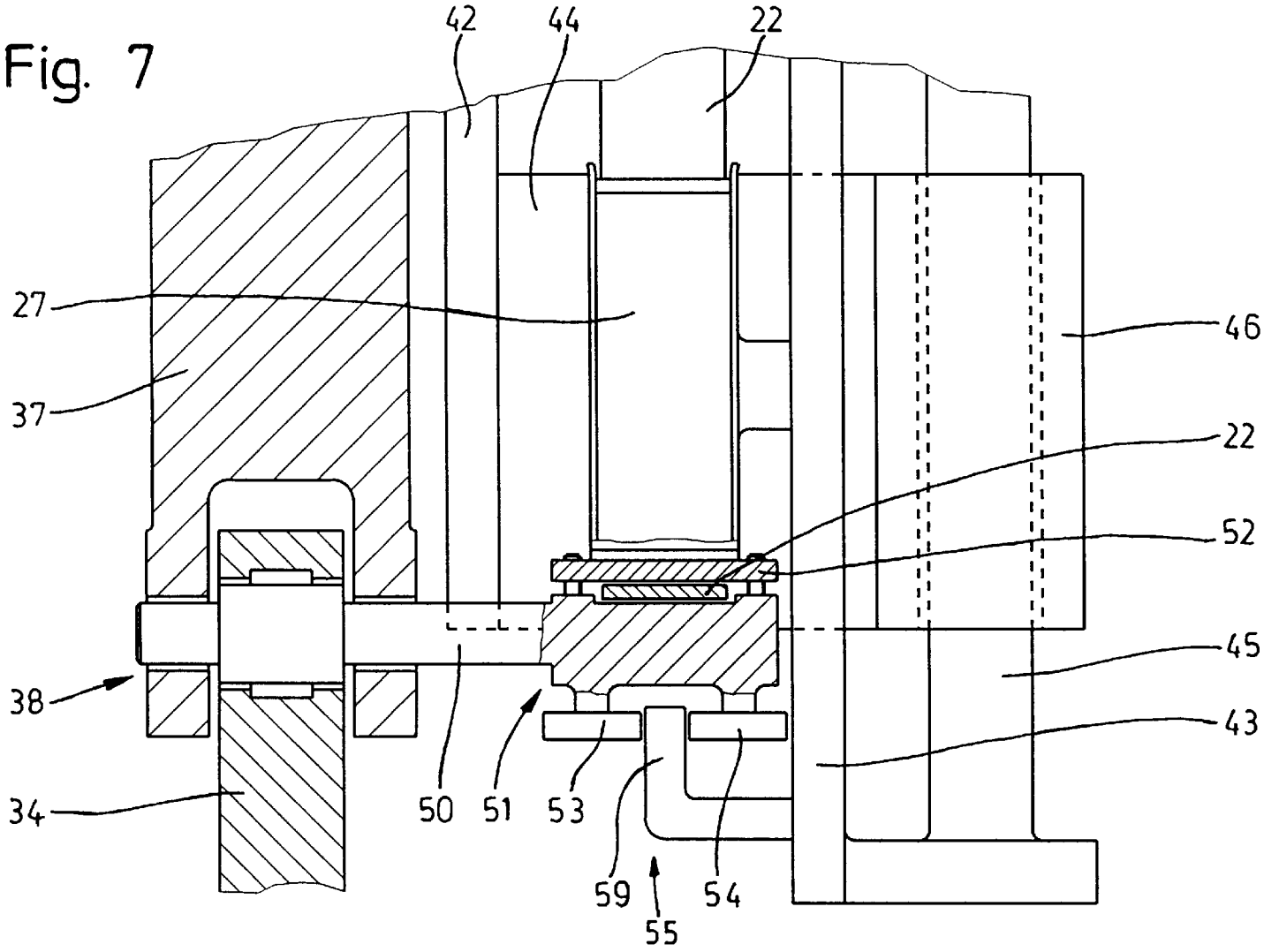
FIG. 7 shows, on an enlarged scale, a detail of the lifting conveyor in cross-section.

During movement of the lifting head 18, or of the carrying arm 34, along the movement path, the carriage 42 is moved out of the end position shown in FIG. 4 (set-down position 19) into the opposite end position (receiving position 20), which can be seen from FIG. 5. Throughout the movement cycle, the lever parallelogram 35 causes the carrying arm 34 to maintain an upright position.

The lifting head 18, or the carrying arm 34 thereof, is connected to the toothed belt 22 in the region of the lever parallelogram 35. One of the free articulations, namely the top articulation 38, is anchored on the toothed belt 22. A pin 50 of this articulation 38 is connected to a coupling piece 51 which in turn is fastened to the toothed belt 22 by clamping means. A clamping plate 52 secures the coupling piece 51 on the toothed belt 22 by frictionally locking and positively locking anchorage.

The coupling piece 51 also serves for guiding the lever parallelogram 35, and thus the lifting conveyor 18, along the U-shaped movement path. For this purpose, guide elements, namely two pairs of running rollers 53 and 54, are fitted on the coupling piece 51. In each case, two of these running rollers 53 and 54 are positioned on mutually opposite sides of a fixed guide element which follows the countour of the movement path. This is a guide plate 55 which is affixed to the base plate 43, to be precise at a distance from the latter. The guide plate 55 has a U-shaped countour corresponding to the movement pathof the lifting head 18. The guide plate 55 is connected to the base plate 43 in the region of a top, transversely directed angle 56. A top, horizontally running transverse web 57 serves for guiding the carrying arm 34, or the running rollers 53, 54, in the region of the horizontal conveying section. Upright supporting legs 58, 59 act as a support for the running rollers 53, 54 in the region of teh vertical movement paths. The distance of the guide plate 55 from the base plate 43 is selected such that the running rollers 54, which are directed towards the base plate 43, can run without making contact with said base plate 43.

FIG. 4 shows the advantageous relative positioning of the receiving position 20, the set-down position 19 and the lifting conveyor 21 arranged thereabove. In FIG. 4, the lifting head 18 is located in the bottom position in the region of the set-down position 19. Once the pack group 15 has been deposited in the folding carton 11, the toothed belt 22 is driven rotation of the deflection roller 26 in the counter-clockwise direction—as a result of which the lifting head 18 is moved in the upward direction. The levers 36, 37 of the lever parallelogram 35 are pivoted in the process, likewise in the counter-clockwise direction. The running rollers 53, 54 run on the guide plate 55. In the transition region between the supporting leg 59 and the transverse web 57, said guide plate 55 is designed with a rounded, partially circular contour, with the result that, in accordance with the deflection of the toothed belt 22, the running rollers 53, 54 follow a circle-arc movement path into the horizontal movement direction along the transverse web 57. During this section of movement, the lifting head 18 is displaced horizontally in a top end position, specifically until it has precisely reached the receiving position 20 above the pack group 15 which is held ready there. Deflection of the toothed belt in the region of the deflection roller 23 then moves the lifting head downwards, levers 36, 37 always ensuring the vertical position of the carrying arm 34. In this case, the carriage 42 is located in the extreme (right hand) end position according to FIG. 5. The lifting head 18 is moved downwawrds until a lifting plate 60, which is arranged on the lifting head 18 and is designed in particular as a suction element, can grip the pack group 15. By virtue of the toothed belt 22 being moved in the opposite direction, the lifting head 18, together with the pack group 15, is moved back, to the right, into the set-down position 19 according to FIG. 4.

A further special feature of the apparatus consists in the fact that containers, in particular folding cartons 11, of very different sizes, namely base surface areas, can be processed automatically. For this purpose, the containers or folding cartons 11 are always provided at a fixed point or in an aligned position in the set-down position 19, to be precise, irrespective of the size of the container.

Figures 2, 3:
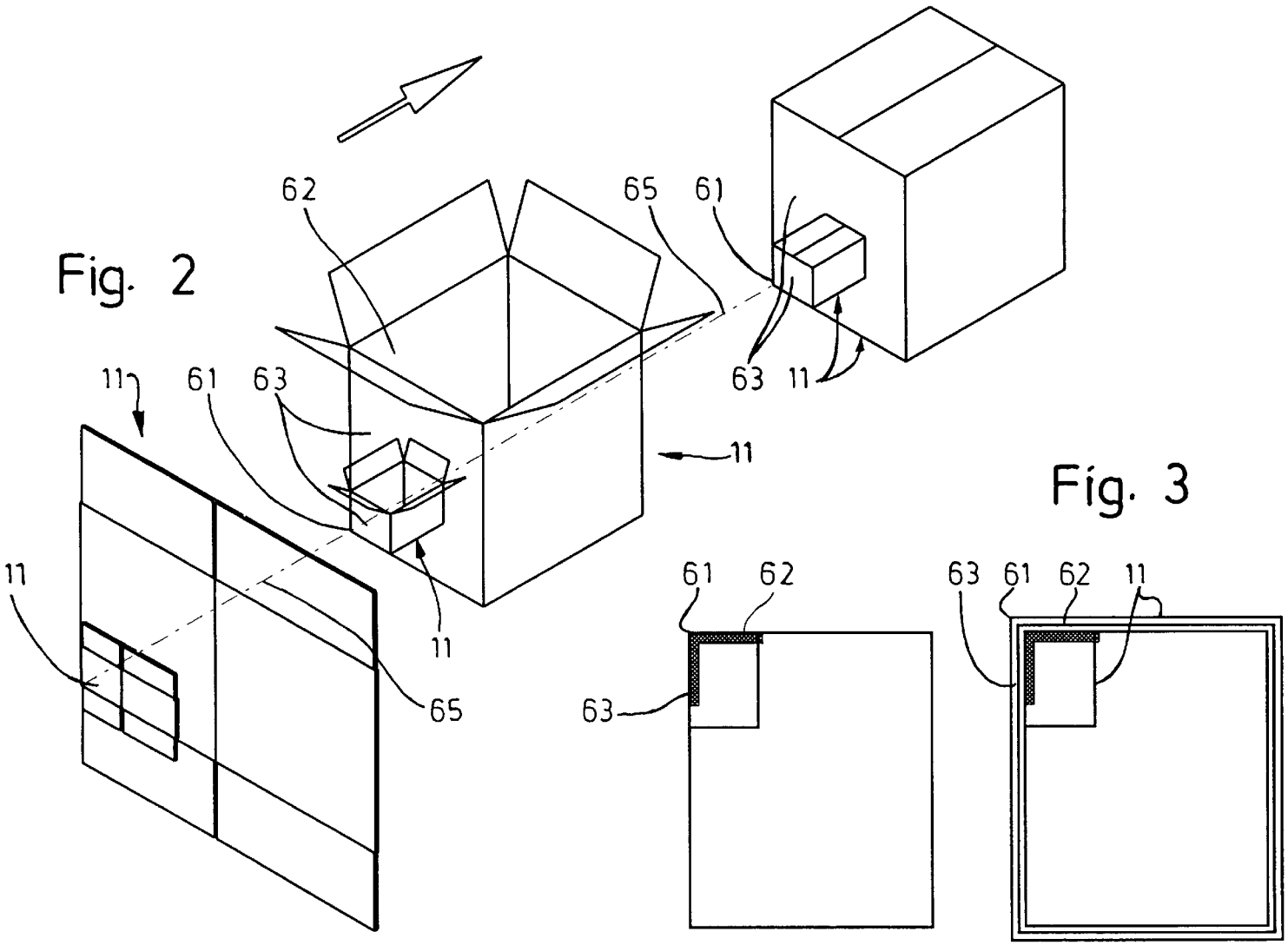
FIG. 3 shows the schematic ground plan for placing folding cartons in an aligned position.

The fixed point for the folding cartons 11 may be, for example, the center point thereof, that is to say, the center point of a base surface. In the exemplary embodiment shown (FIG. 3), a container corner 61 has been selected as the fixed point. The containers or folding cartons 11 are always aligned with this fixed point, that is to say, with the container corner 61, irrespective of their size. The position of the containers is selected such that adjacent parts, namely side walls 62, 63 always extend in the same (vertical) plane likewise irrespective of the size of the carton.

The lifting member (which may be any lifting member of suitable design), namely the lifting head 18, is moved such that the fixed point, that is to say, the container corner 61, defines the set-down position 19. The downward movement of the lifting head 18 in the region of this set-down position 19 always takes place such that, even with the smallest design of the folding carton 11, the lifting head 18 can set down the packs 10 or pack group 15 within said carton. When particularly large folding cartons 11 are used, it may be expedient for the lifting platew 60 on the lifting head 18 to be exchanged for a correspondingly larger lifting plate 60, which is then fitted releasably, in an eccentric position, on the lifting head 18, or on the carrying arm 34.

Once they have been erected, the containers, namely folding cartons 11, are fed to the set-down position 19 such that they are provided precisely in the fixed point. As can be seen from FIG. 2, the folding cartons 11, or the blanks thereof, are always moved by way of a bottom, horizontal pack edge along a defined, predetermined conveying line 65, until the filled folding carton 11 has been closed.

In the present exemplary embodiment (FIG. 1), collapsed, flat blanks 66 for folding cartons 11 are removed from a magazine 67. Suitable elements erect the folding carton 11 into a three-dimensional, sleeve-like form which is open at the top and bottom. Pre-folding means 68 pivot upwardly directed folding flaps 69 of the folding carton 11 outwards, as a result of which access to the folding carton 11 from above is made easier. During transportation into the set-down position 19, base flaps 70 are folded, with the result that a folding carton 11, which is open at the top and has a closed base, is provided in the set-down positioin 19.

Once the folding carton 11 has been filled, first of all folding elements for folding the inner, top folding flaps 69 come into operation, and these are followed, during the transportation of the folding carton, by lateral folding elements, which are designed as folding diverters and close the folding carton 11 at the top.

The lifting conveyor 21 according to the invention may also be used for other purposes if articles are to be transported from a predetermined receiving position 20 into a likewise predetermined set-down position 19, for example, from one conveyor to another.

What is claimed is:

1. An apparatus for handling articles by receiving, transporting and setting down the articles, said apparatus comprising:

a lifting head (18) for gripping and retaining one or more articles;

a conveyor for moving the articles;

a carrying arm (34) on which the lifting head (18) is disposed, and which is connected to two mutually parallel levers (36, 37);

a carriage (42) on which the levers (36, 37), located opposite the carrying arm (34), are pivoted and are movable such that the lifting head is always directed downwards regardless of angular position of the levers (36, 37), said carriage (42) being movable along the apparatus in a horizontal direction, said conveyor having an inverted U-shaped movement path provided by a first vertical movement section in a region of a predetermined receiving position (20) for vertically raising the lifting head (18), a second vertical movement section in a region of a predetermined set-down position for vertically lowering the lifting head (18), and a horizontal movement section which has a predetermined, non-changeable length, and which interconnects upper ends of said first and second vertical conveying sections for horizontal movement of the lifting head (18), said carrying arm (34) being movable by said conveyor, along the inverted U-shaped movement path, between said predetermined receiving position (20) for the articles and said predetermined set-down position (19) for the articles; and a coupling piece (51) connecting said carrying arm (34) in an articulated manner to said conveyor, wherein during the vertical movement of said lifting head (18) by said conveyor, said lifting head (18) is held in a downwardly directed position by the levers (36, 37) and the horizontal movement of said carriage (42), and wherein the horizontal movement of said lifting head (18) by said conveyor produces a horizontal movement of said carriage (42).

2. The apparatus according to claim 1, further comprising means for aligning a container, to be filled in a region of said set-down position (19) for the articles, with a predetermined, defined fixed point (61), wherein containers of different sizes are always aligned with said fixed point, said set-down position (19) for said lifting head (18) also being aligned with said fixed point.

3. The apparatus according to claim 1, further comprising retaining elements of various sizes which are attached to said lifting head (18), and which correspond to varying sizes of the articles to be handled.

4. The apparatus according to claim 1, further comprising a lifting plate (60) which is on the lifting head (18), which is always directed horizontally, and which has a suction element for receiving a group (15) of the articles.

5. The apparatus according to claim 1, further comprising a guide plate (55) wherein, during movement, said lifting head (18) is supported against lateral movements along said guide plate (55) on which supporting elements of the lifting head (18) run.

6. The apparatus according to claim 5, wherein said supporting elements comprise pairs of running rollers (53, 54) arranged on said coupling piece (51).

7. The apparatus according to claim 1, wherein:

said lifting head (18) is moved only vertically and horizontally, not diagonally;

the horizontal movement of the lifting head (18) is always the same;

the lifting head (18) has a configuration which is independent of weight distribution of the articles;

there are only two of said parallel levers (36, 37); and said levers are connected only to said carriage (42), and not to an external fixed point.

8. The apparatus according to claim 1, wherein:

the conveyor is an endless, driven toothed belt (22) which is movable back and forth and which is guided through at least two upper deflection rollers (23, 24) and two lower deflection rollers (26, 27); and said carrying arm (34) is torsionally connected to said toothed belt (22) by said coupling piece (51).

9. The apparatus according to claim 8, further comprising a main carrier, said carriage (42) being horizontally displaceable on said main carrier, said main carrier being mounted stationary in an upright plane, and said conveyor with the toothed belt (22) being mounted on said main carrier.

* * * * *